US008453664B2

(12) United States Patent
Parsons et al.

(10) Patent No.: US 8,453,664 B2
(45) Date of Patent: Jun. 4, 2013

(54) PORTABLE SHELTER

(76) Inventors: William Parsons, Sheffield (GB); Allen Holland, Sheffield (GB)

( * ) Notice: Subject to any disclaimer, the term of this patent is extended or adjusted under 35 U.S.C. 154(b) by 0 days.

(21) Appl. No.: 13/069,907

(22) Filed: Mar. 23, 2011

(65) Prior Publication Data

US 2012/0240970 A1 Sep. 27, 2012

(51) Int. Cl.
*E04H 15/40* (2006.01)

(52) U.S. Cl.
USPC ..... 135/127; 135/137

(58) Field of Classification Search
USPC ..... 135/116, 124, 128, 130, 137, 138, 135/906
See application file for complete search history.

(56) References Cited

U.S. PATENT DOCUMENTS

| | | | | | |
|---|---|---|---|---|---|
| 2,345,377 | A * | 3/1944 | Bowen | 135/125 |
| 2,869,561 | A * | 1/1959 | Harkness | 135/123 |
| 2,887,234 | A * | 5/1959 | Huey et al. | 211/189 |
| 3,051,185 | A * | 8/1962 | Reynolds | 135/124 |
| 3,165,110 | A * | 1/1965 | Brooks | 135/124 |
| 3,812,616 | A * | 5/1974 | Koziol | 52/63 |
| 4,091,584 | A * | 5/1978 | Brown | 135/127 |
| 4,404,980 | A * | 9/1983 | Wade | 135/123 |
| 4,862,906 | A | 9/1989 | Jordon | |
| 5,595,203 | A * | 1/1997 | Espinosa | 135/124 |
| 5,823,217 | A * | 10/1998 | Rice | 135/124 |
| 5,927,311 | A * | 7/1999 | Jager | 135/124 |
| 5,950,649 | A * | 9/1999 | Gerig | 135/125 |
| 6,289,909 | B1 * | 9/2001 | Wood | 135/124 |
| 6,402,220 | B2 * | 6/2002 | Allen | 296/77.1 |
| 6,662,492 | B2 * | 12/2003 | Oliver | 47/41.1 |
| 7,066,526 | B2 * | 6/2006 | Weddington et al. | 296/105 |
| 7,316,239 | B2 * | 1/2008 | Yang | 135/137 |
| 7,392,555 | B2 | 7/2008 | Danaher | |
| 7,604,016 | B2 | 10/2009 | Songest | |
| 2003/0005953 | A1 * | 1/2003 | Erbetta et al. | 135/151 |

OTHER PUBLICATIONS

United States Patent and Trademark Office, International Search Report and Written Opinion for PCT/US2012/030437, Jun. 20, 2012.

* cited by examiner

*Primary Examiner* — Noah Chandler Hawk
(74) *Attorney, Agent, or Firm* — Kenneth H. Ohriner; Perkins Coie LLP

(57) ABSTRACT

A portable shelter may be provided with ground assembly, flex poles, and a cover assembly. The ground assembly may include a ground sheet or pad having rigid elements, such as metal ground poles along opposite sides. The ground poles may extend through sleeves on the ground sheet. The ends of the flex poles can be attached to fittings on the ends of the ground poles, with the flex poles flexed into an arc when the shelter is set up. The cover assembly includes a flexible cover made for example of fabric effective at blocking sunlight. Flex pole attachment devices, such as snap-on clamp fittings, may be spaced apart along opposite ends of the cover for attaching the cover onto the flex poles. Ground pole attachment devices may be spaced apart along opposite sides of the cover for attaching the cover to the ground poles.

15 Claims, 10 Drawing Sheets

PORTABLE SHELTER

FIELD OF THE INVENTION

The field of the invention is portable shelters.

BACKGROUND OF THE INVENTION

Various types of portable shelters have been known and used in the past. Generally, these types of shelters have a flexible fabric canopy supported by more rigid elements, such as metal or wood ribs, tubes or arches. While these types of shelters have met with varying degrees of success, engineering challenges remain in providing a portable shelter that for example is lightweight and easily carried, provides a high degree of sun protection, resists wind, avoids excessively blocking the user's view, and is easily put up and taken down, even on various types of surface. Accordingly, an improved portable shelter is needed offering improvements in one or more of these characteristics

SUMMARY OF THE INVENTION

A portable shelter may include a ground assembly, flex poles, and a cover assembly. The ground assembly, such as a ground sheet, strips or pad, can be provided with rigid elements, such as metal ground poles, on opposite sides. The ground poles may optionally be made foldable and extend through sleeves on the ground sheet. The ends of the flex poles are attached to the ends of the ground poles, with the flex poles flexed into an arc when the shelter is set up. The cover assembly includes a flexible material cover. Flex pole attachment devices, such as snap-on clamp fittings, may be spaced apart along opposite ends of the cover for attaching the cover onto the flex poles. Ground pole attachment devices may be spaced apart along opposite sides of the cover for attaching the cover to the ground poles. The ground assembly and the cover assembly may optionally be combined into a single assembly which can be folded and/or rolled up for storage or transport.

BRIEF DESCRIPTION OF THE DRAWINGS

In the drawings, the same element number indicates the same element in each of the views.

DETAILED DESCRIPTION

Figure 1:
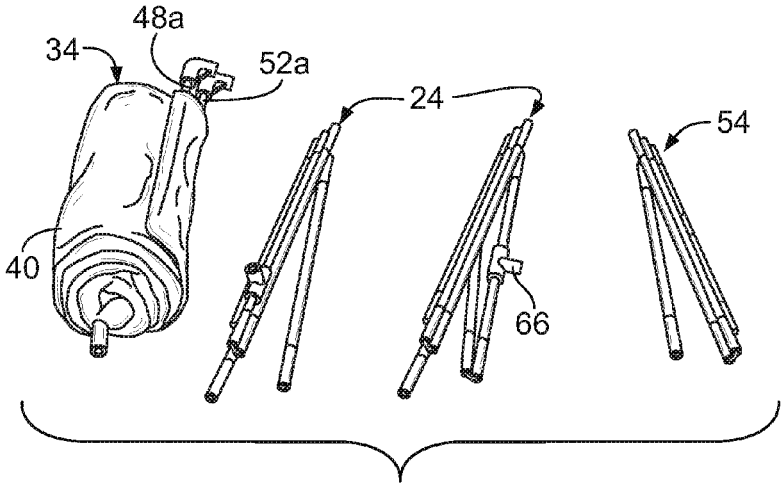
FIG. 1 is a perspective view showing each of the major components of the present shelter in the storage position.
Figure 1A:
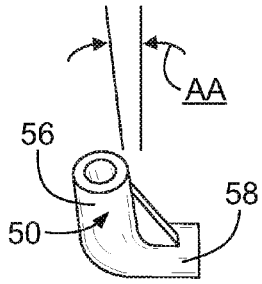
FIG. 1A is an enlarged perspective view of an angle fitting.
Figure 8A:
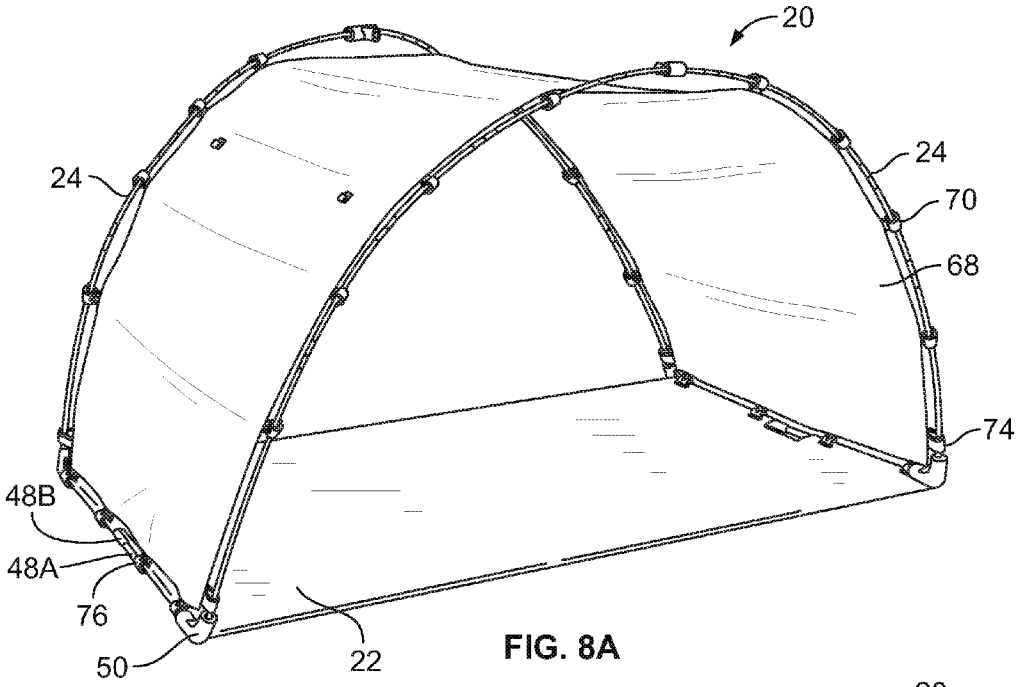
FIGS. 8A and 8B are perspective views of the present shelter before installation of the center flex pole of FIG. 1.
Figure 8B:
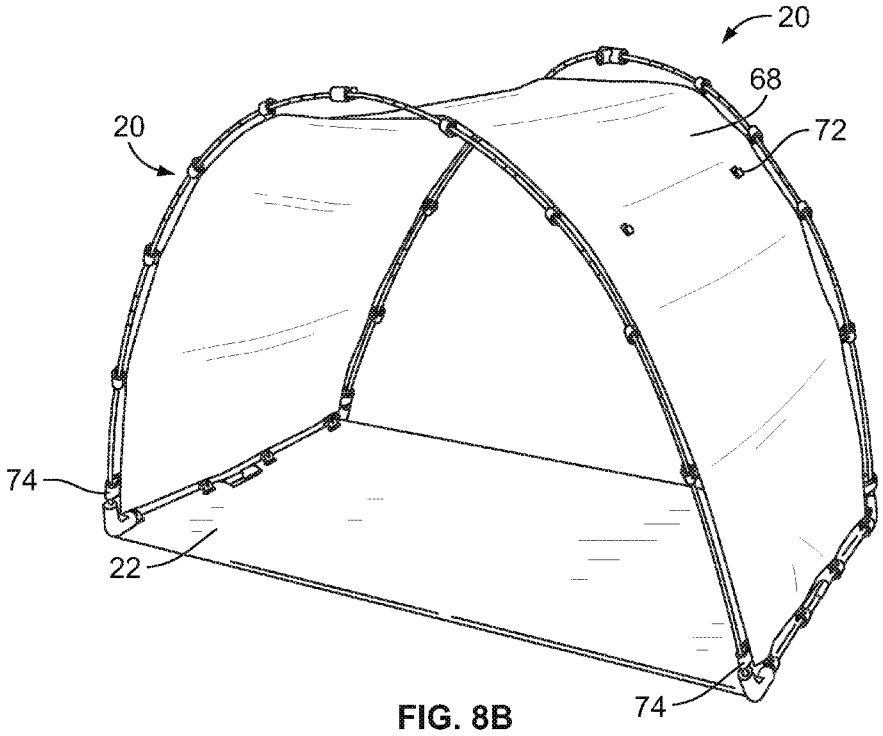
Figure 9:
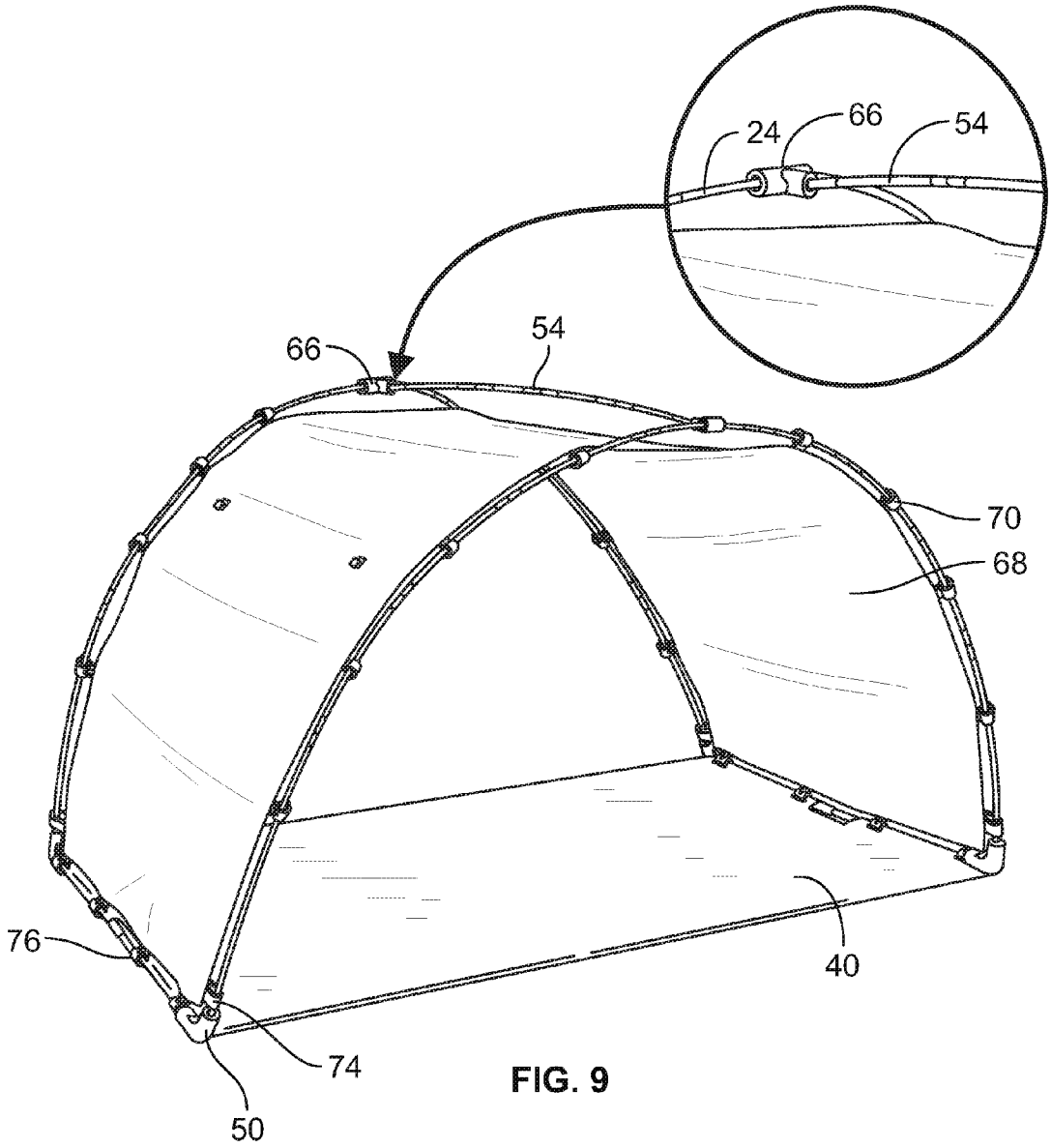
FIG. 9 is a perspective view of the present shelter fully assembled and ready for use.

FIG. 1 shows the present shelter 20 with the components of the shelter folded and/rolled up, for storage or transport, for example in a carrying case or bag. FIG. 9 shows the present shelter 20 fully assembled and ready for use. FIGS. 2 through 8B present a sequence of assembly of the components shown in FIG. 1 and design features of the components.

Figure 2A:
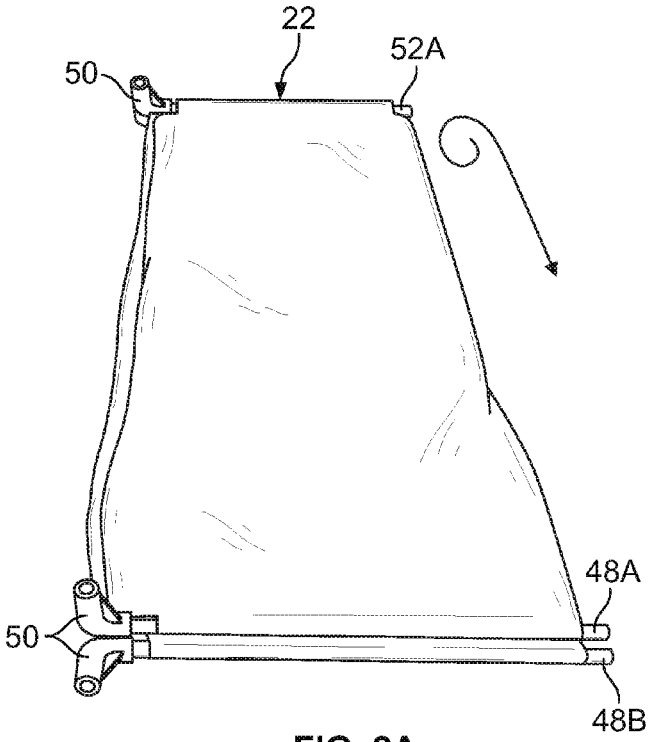
FIG. 2 is a perspective of the shell assembly of FIG. 1 in an unrolled position.
Figure 3:
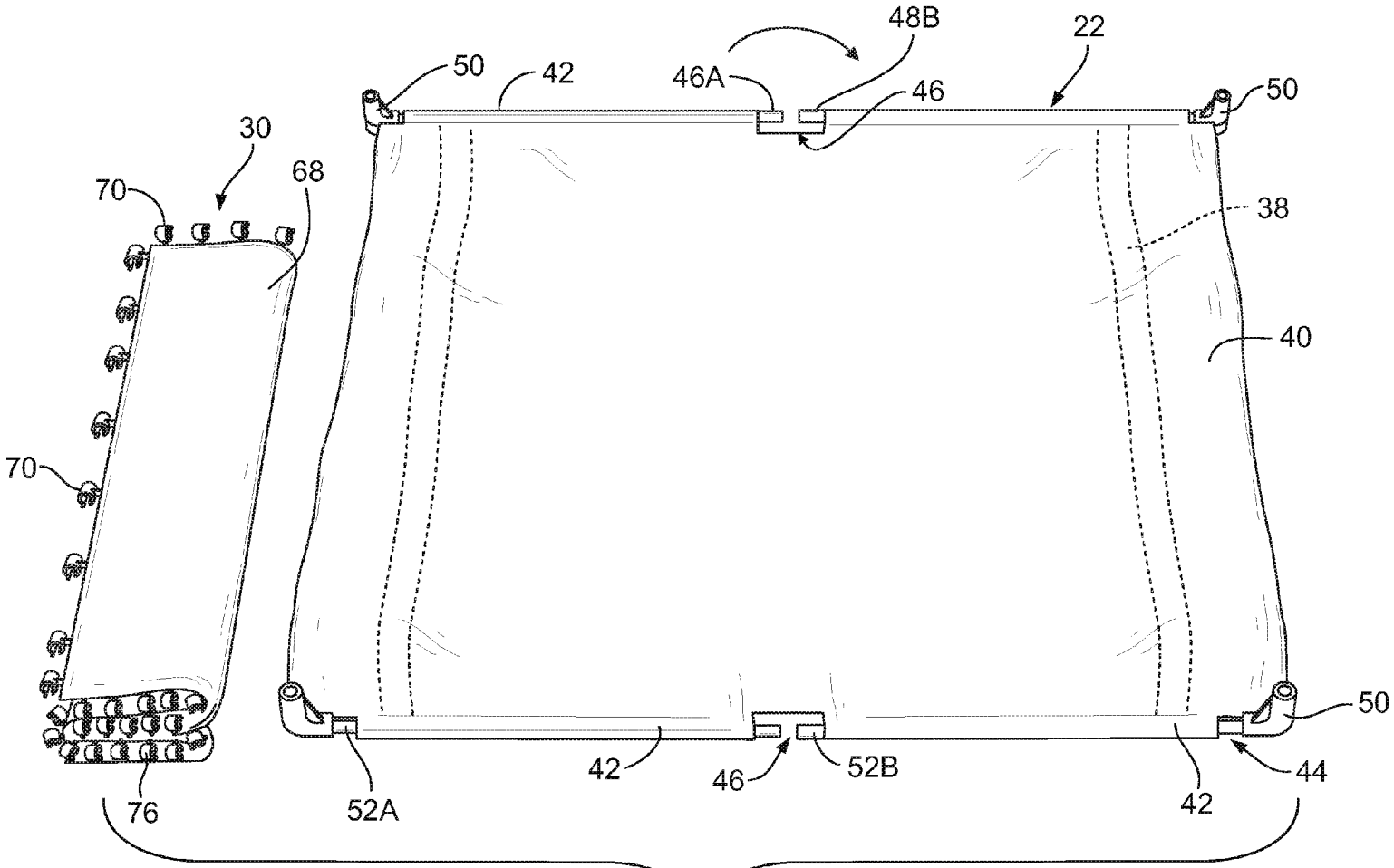
FIG. 3 is a perspective view of the ground unit and the cover unit of the shell assembly of FIGS. 1 and 2 shown separately, with the ground unit fully unrolled and/or unfolded.

As shown in FIG. 1, the portable shelter 20 may include a shelter body 34, two flex side poles 24 and a flex center pole 54. The shelter body 34 in FIG. 1 is shown in the rolled/folded up position, for storage or transport. FIG. 2 shows the shelter body unrolled and folded in half. Referring to FIG. 3, the shelter body 34 includes a cover assembly or unit 30 and a ground assembly or unit 22. FIG. 3 shows the ground assembly 22 unrolled and unfolded, with the cover assembly 30 shown still folded in FIG. 3. In FIG. 1 the cover assembly 30 and the ground assembly 22 are rolled up together, with the ground assembly 22 on the outside and the cover assembly 30 rolled up within the ground assembly 22, so that the cover assembly 30 is not visible in FIG. 1.

Referring to FIG. 3, the ground assembly 22 includes a ground sheet or pad 40 which is typically rectangular, although other shapes may also be used. Left and right side separate sleeves 42 are shown on opposites sides of the pad 40. If used, the sleeves may be provided for example by overlying and stitching an outside layer of material or fabric of the ground pad 40. Corner cutouts 44 can be provided at the corners, so that the sleeves do not extend to the corners of the ground pad 40. Similarly, center cutouts 46 can be located at a center location of the ground pad 40. The shelter 20 may optionally be provided with no ground pad or sheet 40, with only ground strips or webbing 38 extending between the ground poles, as shown in dotted lines in FIG. 3. As used here, ground sheet and ground pad mean an element extending between the ground poles, including one or more strip, strap, web, sheet or pad.

In the example shown, ground poles 48 and 52 extend through the sleeves 42. The ground poles may be provide as two attachable segments, 48A and 48B, and 52A and 52B, to allow the ground assembly 22 to be folded in half as shown in FIG. 2, with the fold line bisecting the ground poles. If the ground poles are provided in segments, the inner end of each of the ground pole segments 48A and 48B, and 52A and 528, may include an attachment fitting, for attaching the pole segment 48A to the pole segment 48B, and for attaching the pole segment 52A to the pole segment 52B.

Figure 4A:
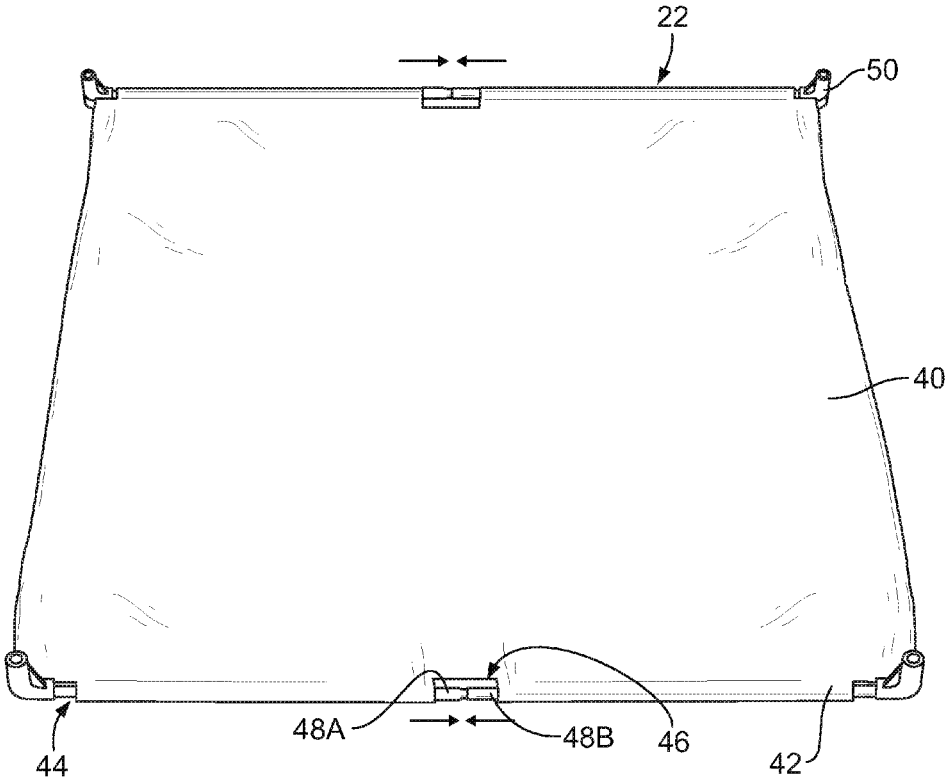
FIG. 4A is a perspective view of the ground unit with the ground poles attached to each other.
Figure 4B:
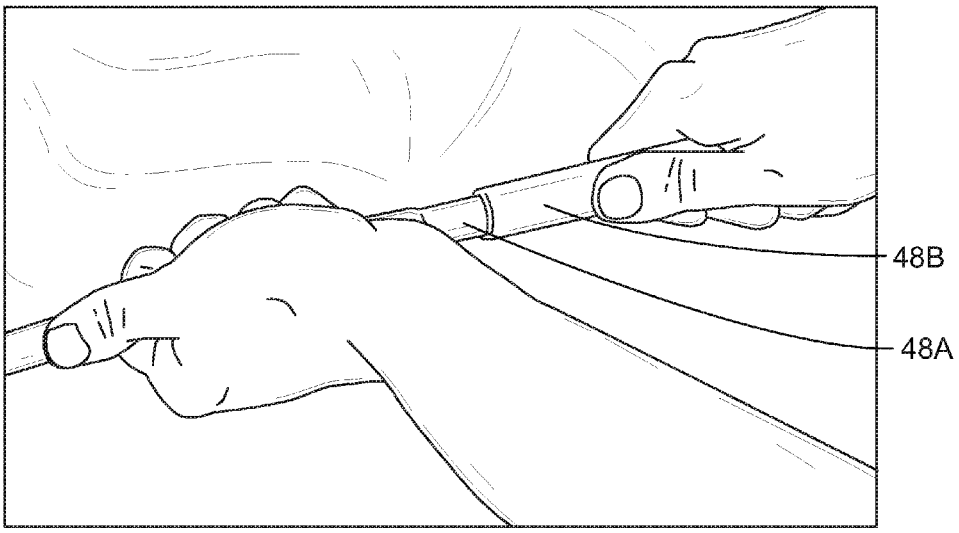
FIG. 4B is an enlarged perspective view showing the attachment of the ground poles shown in FIGS. 3 and 4A.

For example, the inner ends of ground pole segments 48A and 52A may have a male swage fitting that fits into a female swage fitting on the inner ends of the ground pole segments 48B and 52B, respectively. Referring to FIGS. 3, 4A and 4B, if this design is used, the ground pole segments may be attached together by hand, advantageously without using any tools or additional components, by inserting one into the other. The center cutout 46 leaves the inner ends of the ground pole segments 48 and 52 accessible by hand, to allow them to be quickly and easily attached and removed from each during setup and take-down of the portable shelter 20. Of course, various other types of quick connect devices may be used to attach the ground pole segments 48A and 48B, and 52A and 52B together. For example, the segments may be connected by a spring or hinge device, or a slide collar, which attaches the rigid segments together, yet still allows the ground assembly 22 to be folded as shown in FIG. 2. The ground poles 48 and 52 may alternatively be single full length poles, if folding the ground assembly is not needed.

FIG. 4A shows the ground assembly 22 with ground pole segments 48A and 48B, and 52A and 52B, attached together to form full length ground poles 48 and 52 within the sleeves 42 along each longer side of the ground pad 40. A fitting 50 is attached to the outer end of the each of the ground poles, as shown in FIG. 3. If the ground poles 48 and 52 are single full length poles, then the fittings 50 at each end of ground poles 48 and 52 captivates the pole within the sleeves 42.

If the ground poles are provided as segments 48A, 48B, 52A and 52B, then the segments may slide into and out of the sleeves 42. Alternatively, the segments may be attached to the ground pad 40 via rivets, fasteners, adhesives, etc., to substantially permanently attach the segments to the ground pad. Allowing the segments to slide within the sleeves may be helpful or necessary where they are attached to each using swaged or similar types of end attachments.

Figure 5:
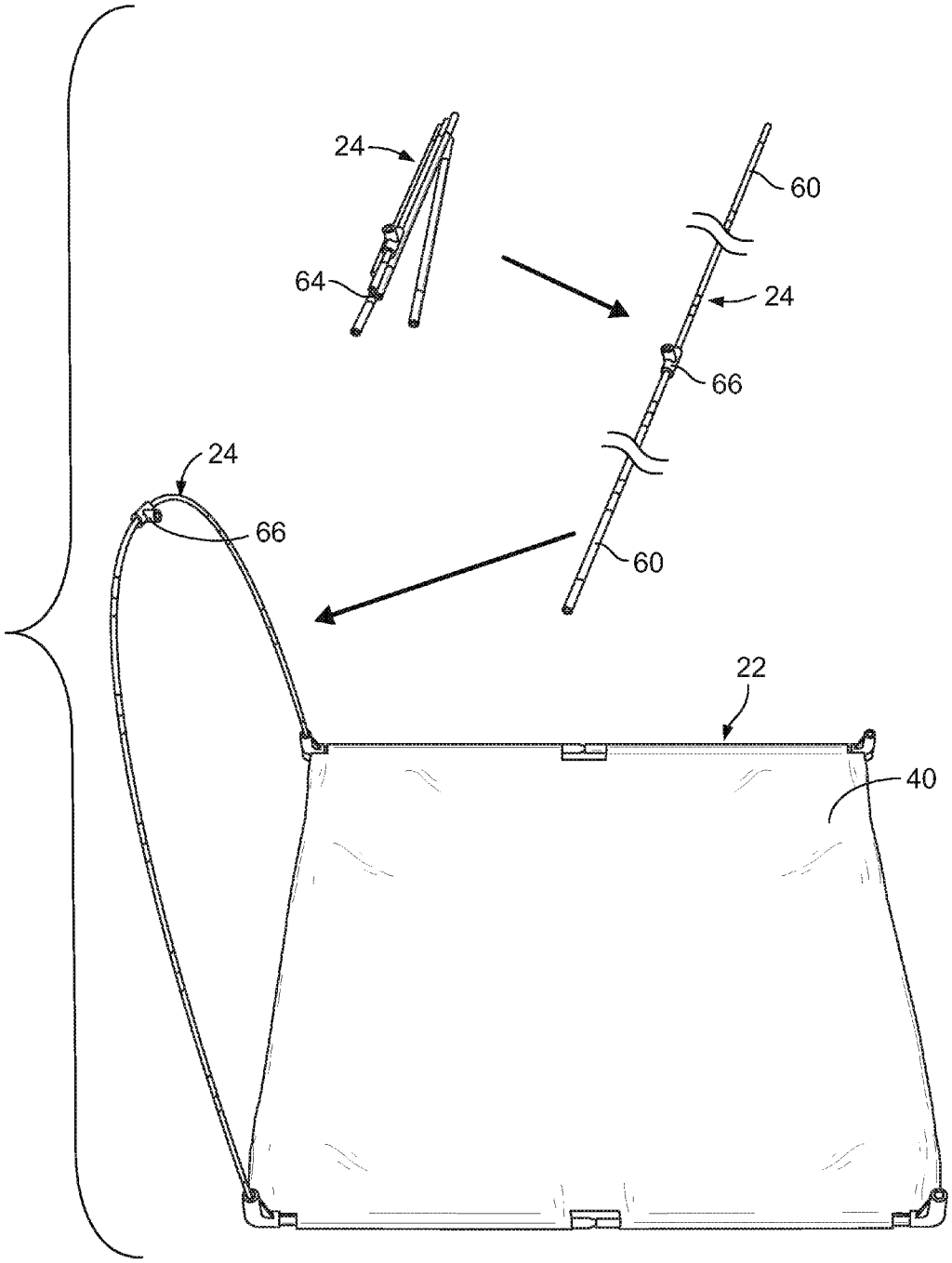
FIG. 5 is perspective view showing installation of the side flex poles of FIG. 1.
Figure 6:
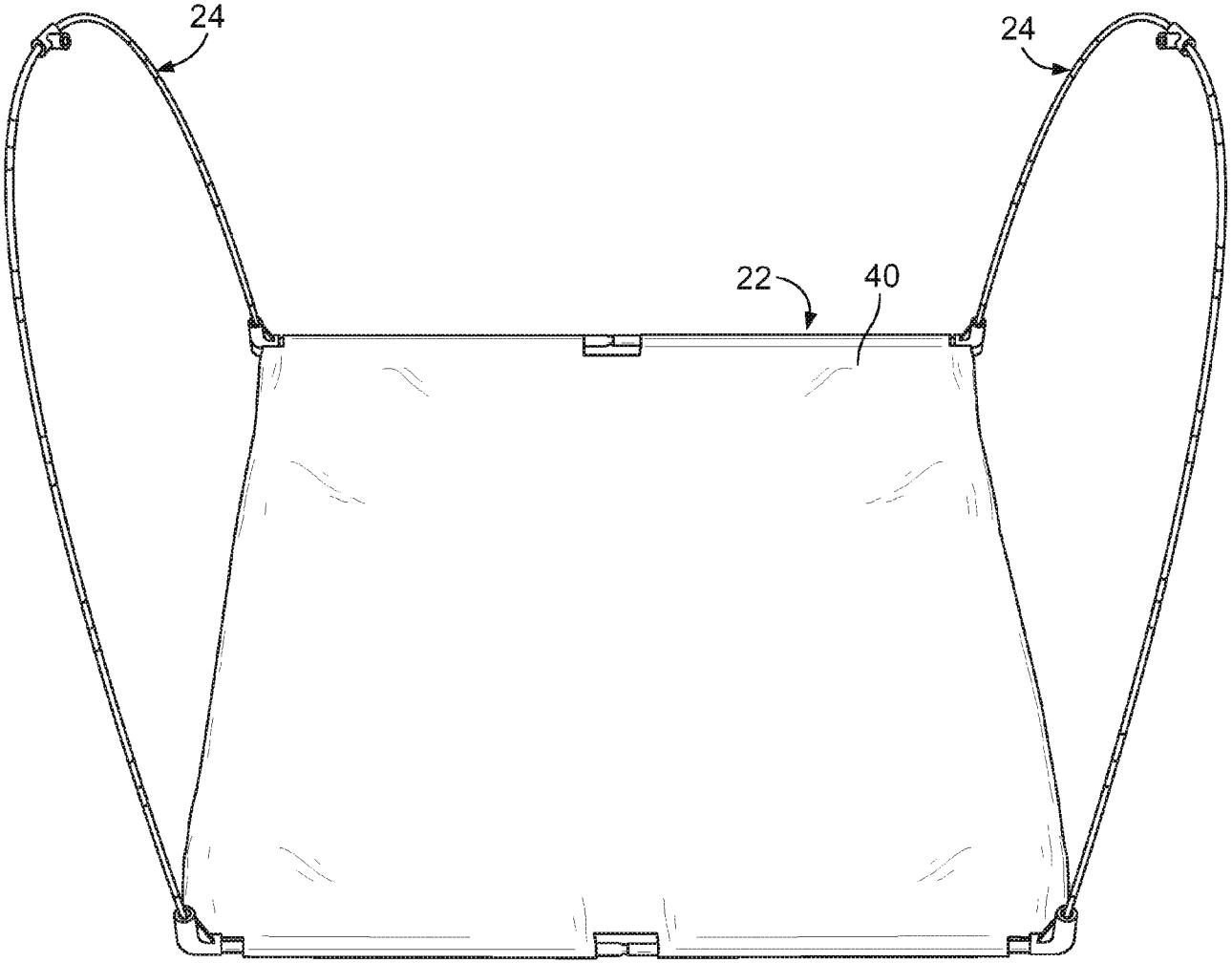
FIG. 6 is a perspective view the side flex poles installed on the ground unit.

FIG. 5 shows a typical next step in setting up the shelter 20, with one of the flex side poles 24 unfolded, and with the ends of the flex side pole 24 inserted into the fittings 50 on the ground poles 48 or 52, on one side of the ground pad 40. Each of the flex side poles 24 may be formed of fiberglass tube segments 60 with attaching end fittings. A central shock cord 64 may be threaded through the segments 60 to hold the segments together when folded. FIG. 6 shows both flex side poles 24 installed on the ground unit 22.

As shown in FIGS. 6-9, the flex poles 24 are aligned substantially parallel to each other at opposite ends of the ground pad or sheet 40. The flex poles 24 do not cross over or intersect each other. If ground strips, straps or webs 38 are used, they may optionally be attached to the flex poles instead of the ground poles.

Figure 7A:
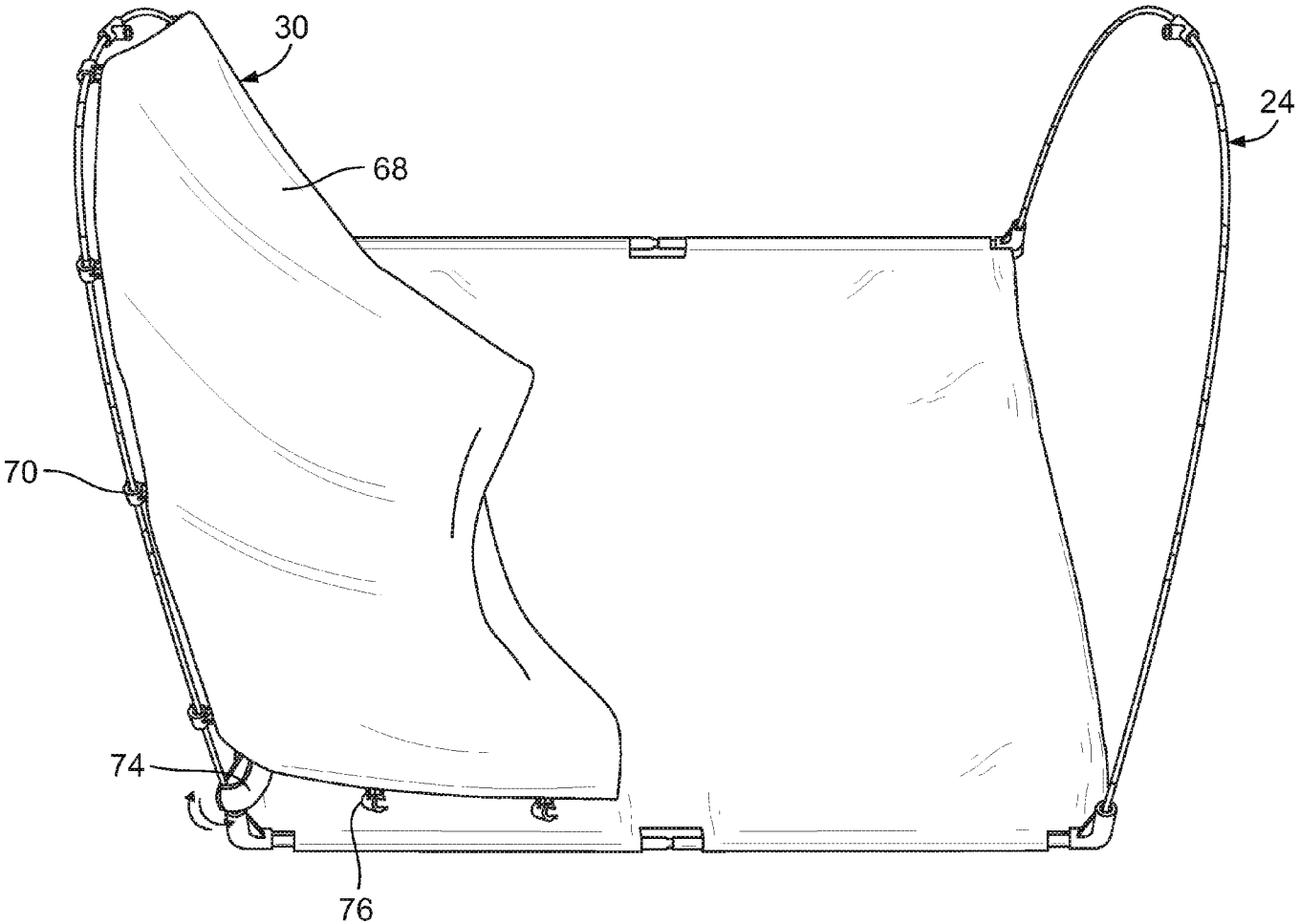
FIG. 7A is a perspective view of the cover assembly of FIG. 3 attached to one side flex pole.
Figure 7B:
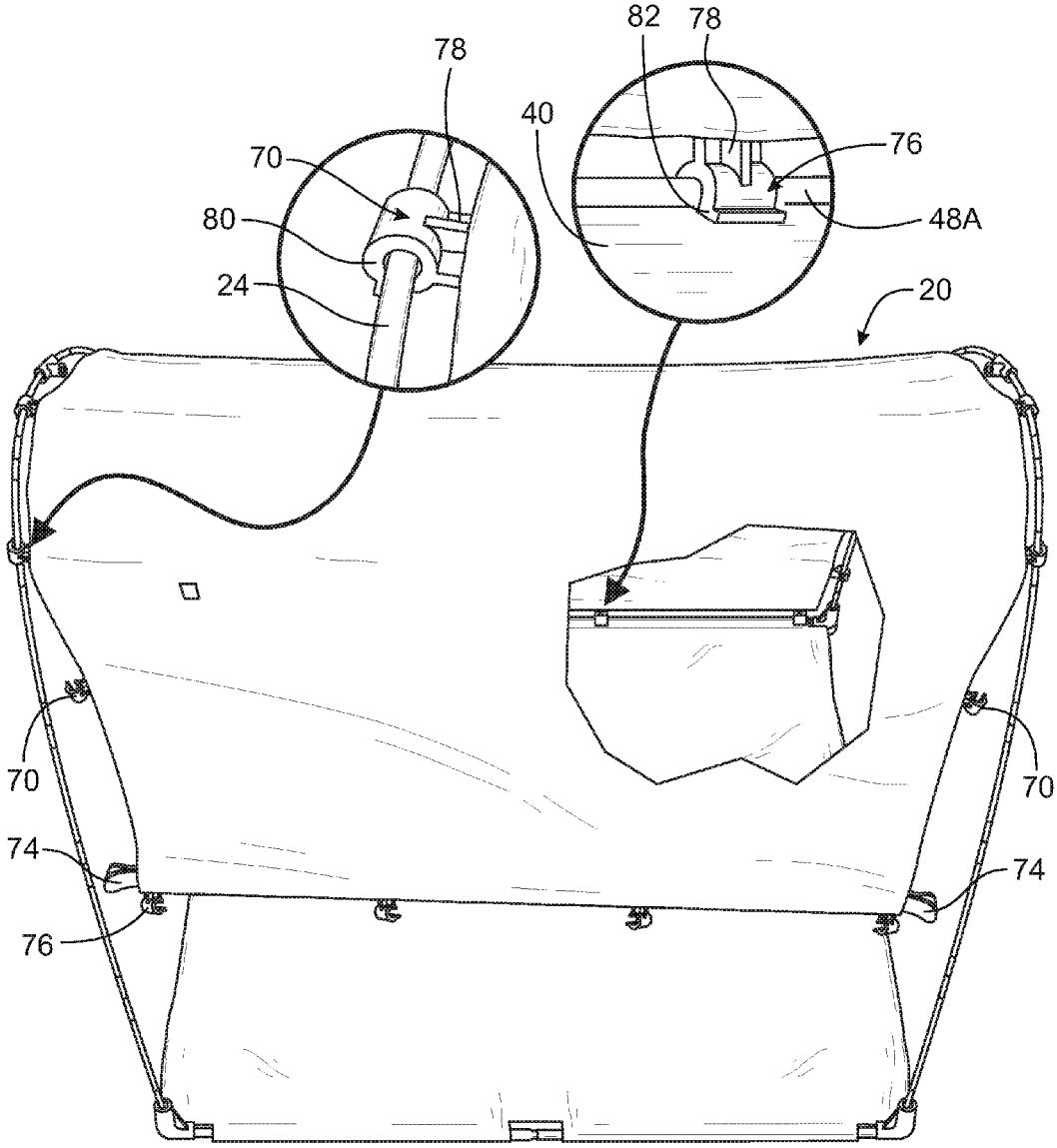
FIG. 7B is a perspective view of the cover assembly of FIG. 3 attached to one ground pole and two flex poles, and also showing enlarged detail views of the attachments.

Turning now to FIGS. 3, 7A and 7B, the cover assembly 30 includes cover sheet 68, which may be a flexible fabric or material effective to block sunlight and rain. Side clamps 70 are spaced apart along the left and right sides of the cover sheet 68, as it is shown in FIG. 7A. Ground clamps 76 are spaced apart along front and back edges of the cover sheet 68, again as shown in FIG. 7A. The side clamps 70 and the ground clamps 76 each have a base 78 and a head. The base 78 of substantially each of the side clamps 70 and the ground clamps 76 may be attached to the cover sheet 68 by stitching, riveting, etc.

The head 80 of each side clamp 70 is configured to clip onto a flex side pole 24. The side clamp 70 may be made of a resilient plastic material, with the head 80 having a C-shape able to snap over and hold onto a flex side pole 24. The ground clamps 70 may have a similar design, but configured to snap over and hold onto a ground pole 48 or 52, and the sleeve 42 around ground pole. Other devices for attaching the cover sheet 68 to the side poles and/or the ground poles may be used, such as string ties, Velcro hook and loop tape ties, sleeves on the cover sheet 68, etc.

As illustrated in FIGS. 7A, 7B, 8A and 8B, in the design shown, the cover assembly 30 is installed onto the flex side poles 24 by snapping the side clamps 70 onto the flex side poles. The cover assembly is installed onto the ground assembly 22 by snapping the ground clamps around the sleeves 42 and the ground poles 48 and 52. Corner ties 74 may be provided at each corner of the cover sheet 68. If used, the corner ties 74 are attached around the flex side poles 24 as well, for example via a snap fitting on each of the ties 74.

In FIG. 9, the center flex pole 54, if used, is unfolded and the ends of the center flex pole 54 are inserted into the center fittings on the flex side poles 24. FIGS. 8A and 8B show the present portable shelter 20 assembled and ready for use, without the center flex pole 54. FIG. 9 shows the present portable shelter assembled and ready for use, with the center flex pole 54.

Referring to FIGS. 1A, 5, 6, 7A and 7B, the fitting 50 may have first and second arms 56 and 58 oriented at an obtuse angle AA ranging from about 95 to 120 degrees opening 56. Consequently, as shown in FIGS. 5, 6, 7A and 7B, the side flex poles extend upwardly and outwardly away from each other. If the cover assembly 30 is wider than the ground pad 40, the outward tilt of the flex side poles 24 tends to hold the cover assembly out beyond each side of the ground pad 40. This can help to provide a greater shaded area on the ground pad 40.

The portable shelter 20 may be dis-assembled by removing the clamps 70, and the ties 74 if used, from the flex side poles 24, and then removing the flex side poles 24 from the fittings 50. The flex side poles 24 can then be folded up, as shown in FIG. 1. The center flex pole 54, if used, is simply removed from the center fittings 66 and folded up. The ground pole segments 48 and 52 are separated from each other. The ground pad 40 can then be folded in half, back to the position shown in FIG. 2, and then rolled up, back to the position shown in FIG. 1. The cover assembly 30 need not be separated from the ground pad 40. Rather, the cover assembly 30 can remain attached to the ground pad 40 via the ground clamps clamping over the sleeves and the ground poles.

Figure 10:
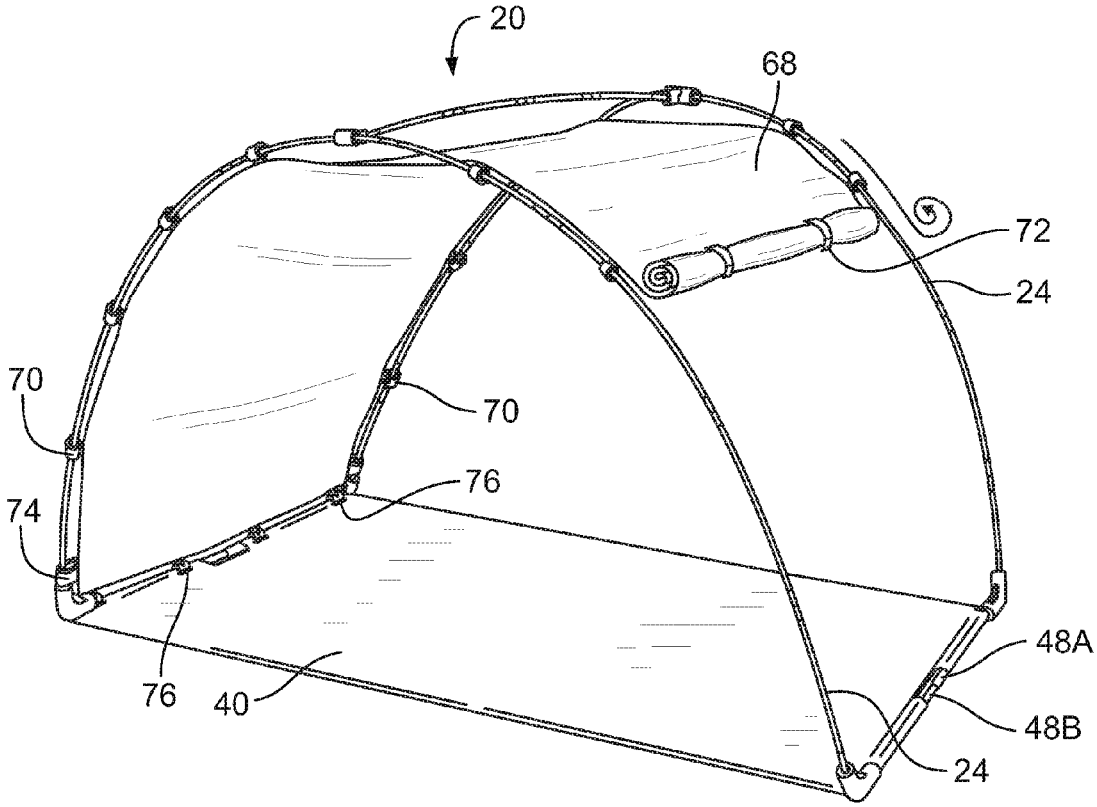
FIG. 10 is a perspective view of the present shelter as shown in FIG. 9, and with one end of the cover assembly rolled up to provide a more open design.

As shown in FIG. 10, one end of the cover sheet 68 may optionally be rolled or folded up, and tied in place via roll-up ties or loops on the underside of the cover sheet 68 secured onto hooks 72 on the top side of the cover sheet 68.

Thus, a novel portable shelter has been shown and described. Various changes and substitutions may of course be made without departing from the spirit and scope of the invention. The invention, therefore, should not be limited except by the following claims and equivalents of them.

The invention claimed is:

1. A portable shelter comprising:

a ground assembly including:

a ground sheet having first and second sides and front and back ends; first and second sleeves at the first and second sides of the ground sheet, respectively; first and second ground poles extending through the first and second sleeves, respectively; first, second, third and fourth fittings, with a first fitting attached to a front end the first ground pole, a second fitting attached to front end of the second ground pole, a third fitting attached to a back end of first ground pole and a fourth fitting attached to a back end of the second ground pole; with each fitting having a first leg attached at an obtuse angle to a second leg;

a front flex pole having a first end attached to the first fitting and a second end attached to the second fitting, with the front flex pole flexed into a front arc;

a back flex pole having a first end attached to the third fitting and a second end attached to the fourth fitting, with the back flex pole flexed into a back arc; and a cover assembly including a flexible cover having first and second sides and front and back ends; a plurality of front flex pole attachment devices spaced apart along front end of the cover and attached to the front flex pole; a plurality of back flex pole attachment devices spaced apart along back end of the cover and attached to the back flex pole; a plurality of first ground pole attachment devices spaced apart along first side of the cover and attached to the first ground pole; and a plurality of second ground pole attachment devices spaced apart along second side of the cover and attached to the second ground pole.

2. The portable shelter of claim 1 with the first and second sleeves sewn into the ground sheet.

3. The portable shelter of claim 2 with the pairs of ground pole segments comprising rigid metal tubes.

4. The portable shelter of claim 1 further comprising a front center fitting on the front flex pole and a back center fitting on the back flex pole, and a center flex pole having a front end attached to the front center fitting and a back end attached to the back center fitting, with the center flex pole attached only to the front and back center fittings and extending directly between the front and back flex poles in a single span.

5. The portable shelter of claim 1 with the ground sheet comprising a ground pad.

6. The portable shelter of claim 1 wherein on each of the first, second, third and fourth fittings, the first leg is attached to the second leg at an obtuse angle ranging from 95 to 130 degrees.

7. The portable shelter of claim 1 with the front and back flex pole attachment devices comprising resilient material clamps.

8. The portable shelter of claim 1 with the first ground pole attachment devices attached around the first sleeve and around the first ground pole, and with the with the second ground pole attachment devices attached around the second sleeve and around the second ground pole.

9. The portable shelter of claim 1 with the first ground pole biased away from the second ground pole via spring force exerted by the front and back flex poles.

10. The portable shelter of claim 1 with the first and second ground poles each foldable substantially in half to a length AA, and with the front and back flex poles each foldable to a length not exceeding AA.

11. The shelter of claim 1 with the front and back flex poles flexed into a front arc lying in a front plane and a back arc lying in a back plane, respectively, with the front plane not parallel to the back plane.

12. A portable shelter comprising:

a ground sheet having first and second sides and front and back ends;

a first ground pole attached to the first side of the ground sheet;

a second ground pole attached to the second side of the ground sheet;

first and second fittings attached to first and second ends of the first ground pole;

third and fourth fittings attached to first and second ends of the second ground pole, with each fitting having a first and second legs with the first leg attached at an angle to a second leg, and with the first leg oriented at an obtuse angle to the second leg in each of the fittings;

a front pole flexed into a front arc and lying substantially in a front plane and having a first end attached to the first fitting and a second end attached to the second fitting;

a back pole flexed into a back arc and lying substantially in a back plane and having a first end attached to the third fitting and a second end attached to the fourth fitting, with the front plane and the back plane extending upwardly and outwardly away from each other;

a fabric cover having first and second sides and front and back ends;

a plurality of front pole clamps spaced apart along the front end of the cover and releasably clamped onto to the front pole;

a plurality of back pole clamps spaced apart along back end of the cover and releasably clamped onto the back pole;

a plurality of first ground pole clamps spaced apart along first side of the cover and releasably clamped onto first ground pole; and a plurality of second ground pole clamps spaced apart along second side of the cover and releasably clamped onto the second ground pole.

13. The portable shelter of claim 12 with the ground sheet including first and second sleeves at the first and second sides of the ground sheet, respectively;

and with the first rigid ground pole attached to the first side of the ground sheet by positioning the first rigid ground pole at least partially within the first sleeve, and with the second rigid ground pole attached to the second side of the ground sheet by positioning the second rigid ground pole at least partially within the second sleeve.

14. The portable shelter of claim 12 with the first and second ground poles each including a pair of ground pole segments attached to each other.

15. The portable shelter of claim 12 further comprising a front center fitting on the front pole and a back center fitting on the back pole, and a center pole having a front end attached to the front center fitting and a back end attached to the back center fitting, with the center pole attached only to the front and back center fittings and extending directly between the front and back poles in a single span having no intermediate supports.

* * * * *